US007328949B2

(12) United States Patent
Donovan et al.

(10) Patent No.: US 7,328,949 B2
(45) Date of Patent: Feb. 12, 2008

(54) ROCKER CHAIR BASE

(75) Inventors: Bobby Donovan, Mooreville, MS (US); Bill Tacker, Smithville, MS (US)

(73) Assignee: L & P Property Management Company, South Gate, CA (US)

( * ) Notice: Subject to any disclaimer, the term of this patent is extended or adjusted under 35 U.S.C. 154(b) by 63 days.

(21) Appl. No.: 11/368,653

(22) Filed: Mar. 6, 2006

(65) Prior Publication Data

US 2007/0205645 A1 Sep. 6, 2007

(51) Int. Cl.
*A47C 3/02* (2006.01)

(52) U.S. Cl. ..... 297/259.2; 297/DIG. 7

(58) Field of Classification Search ..... 297/259.2, 297/259.1, 259.4, DIG. 7, 271.1, 271.3, 271.4, 297/463.1

See application file for complete search history.

(56) References Cited

U.S. PATENT DOCUMENTS 4,071,276 A * 1/1978 Cecil ..... 297/85
5,435,622 A * 7/1995 Fay et al. ..... 297/259.2
5,531,502 A * 7/1996 Berggren ..... 297/131
6,000,754 A * 12/1999 Lawson ..... 297/259.2
6,918,632 B2 * 7/2005 Maki et al. ..... 297/258.1
2006/0250006 A1 * 11/2006 Guillot ..... 297/261.1
2006/0290174 A1 * 12/2006 Hoffman et al. ..... 297/84

* cited by examiner

*Primary Examiner*—Milton Nelson, Jr.
(74) *Attorney, Agent, or Firm*—Shook, Hardy & Bacon, L.L.P.

(57) ABSTRACT

A rocker mechanism for a rocker recliner chair having a seat, a back, a pair of armrests, and a recliner mechanism. The rocker mechanism includes a support portion and a pair of rocker cams. The support portion includes a pair of side rails with a cross plate interconnecting the side rails and extending between the sides of the chair. The rocker cams include a cam portion and a sidewall. The cam portion rests upon an upper surface of the side rails. The sidewall projects upwardly from the rocker cam. A second cross plate interconnects the sidewalls of the rocker cams. The cross plates contain a number of tabs formed therein. The tabs on the first and second cross plates are used to mount a pair of spring sets there between.

21 Claims, 8 Drawing Sheets

ROCKER CHAIR BASE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to a rocker recliner chair and more particularly to a rocker mechanism for a rocker recliner chair.

Rocker recliners are generally well known in the furniture industry. These rocker recliners are chairs that allow the user to rock and that are equipped with extendable footrests that allow the user to recline. This reclining motion is achieved in rocker recliner chairs with a linkage mechanism that is coupled to a rocker mechanism. The rocker mechanism is also generally well known in the furniture industry. FIGS. 7 and 8 show a typical prior art rocker recliner mechanism. As shown, the rocker mechanism typically has a pair of side rails 98 that are interconnected with a pair of cross rails 100. The rocker mechanism also includes a rocker cam assembly, shown generally as item 96. The rocker cam assembly is typically coupled to the side rails. The rocker cam assembly also couples the linkage mechanism of the chair to the rocker mechanism. The prior art rocker cam assembly 96 includes a pair of rocker cams 102 and a pair of mounting brackets 104. The rocker cams 102 are typically made from wood and have a curved cam surface that contacts an upper surface of the side rails. The curved cam surface allows the rocking motion of the chair. The mounting brackets 104 are formed from stamped steel and attach to an upper surface of the rocker cams. The mounting brackets then also attach to the linkage mechanism. Finally, the mounting brackets are also interconnected with the pair of cross rails 106. A pair of spring retention devices 108 are then coupled to both the first and second pairs of cross rails 100, 106 with a set of springs 110 mounted there between. The springs resist the rocking motion of the chair and bias the chair to a neutral at rest position.

This type of prior art rocker mechanism, while functional, suffers from a number of drawbacks. First, the design of the cross rails, the spring cups, and the mounting brackets greatly increases the complexity of both the assembly and the manufacturing processes. Second, the number of parts requires multiple fasteners and couplers. The high number of extra parts results in an increased material cost. Third, the wood material used for the cam can become deformed over time due to spring pressure, resulting in a flat spot on the curved cam surface that prevents a smooth rocking motion.

Thus, while rocker mechanisms are known, there remains a need for an improved rocker mechanism for a rocker recliner that achieves an improved function with a reduced number of parts and connections for ease of manufacturing and decreased production costs.

BRIEF SUMMARY OF THE INVENTION

Accordingly, the present invention provides a rocker mechanism for a rocker recliner chair with a reduced number of working parts and connectors as well as improved performance. A brief overview of the rocker recliner and its components follows immediately below. A more detailed description is provided in the Detail Description of the Invention section.

In general, the rocker recliner chair includes a rocker mechanism, a seat, a pair of armrests, a footrest, a backrest, and a pair of linkage mechanisms mounted on opposite sides of the chair. Each of the linkage mechanisms is coupled to the rocker mechanism and moves the rocker recliner chair between a closed (chair position), an open (TV position), and a fully reclined position.

The rocker mechanism includes a support portion and a pair of rocker cams. The support portion includes a pair of side rails positioned on opposite sides of the chair and extending between front and rear portions of the chair. A first cross plate interconnects the side rails and extends between the sides of the chair. The first cross plate is formed from stamped steel and is attached to the side rails by weldment. The first cross plate is attached at a position intermediate the front and rear portions of the chair. The first cross plate contains a number of tabs formed therein for facilitating attachment to a second cross plate by a plurality of spring sets.

The rocker cams are formed from stamped steel and include a cam portion and a sidewall. The cam portion rests upon an upper surface of the side rails and facilitates the rocking movement of the chair. The sidewall projects upwardly from the cam portion and includes a plurality of apertures. The apertures are used to mount the linkage mechanisms to the rocker mechanism.

The second cross plate interconnects the sidewalls of the rocker cams. As stated above, the rocker cams rest on the side rails on opposite sides of the rocker mechanism and allow for forward and rearward rocking of the chair. The second cross plate is formed from stamped steel and is attached to the sidewalls by weldment. The second cross plate is attached at a position intermediate the front and rear portions of the chair. The second cross plate contains a number of tabs formed therein. The tabs on the first and second cross plates are used to mount the plurality of spring sets there between.

As will be seen from the detailed description that follows, the rocker mechanism utilizes fewer working parts than any of the previous embodiments contained in the prior art. Additional advantages, and novel features of the invention, will be set forth in part in a description which follows and will become apparent to those skilled in the art upon examination of the following, or may be learned by practice of the invention.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
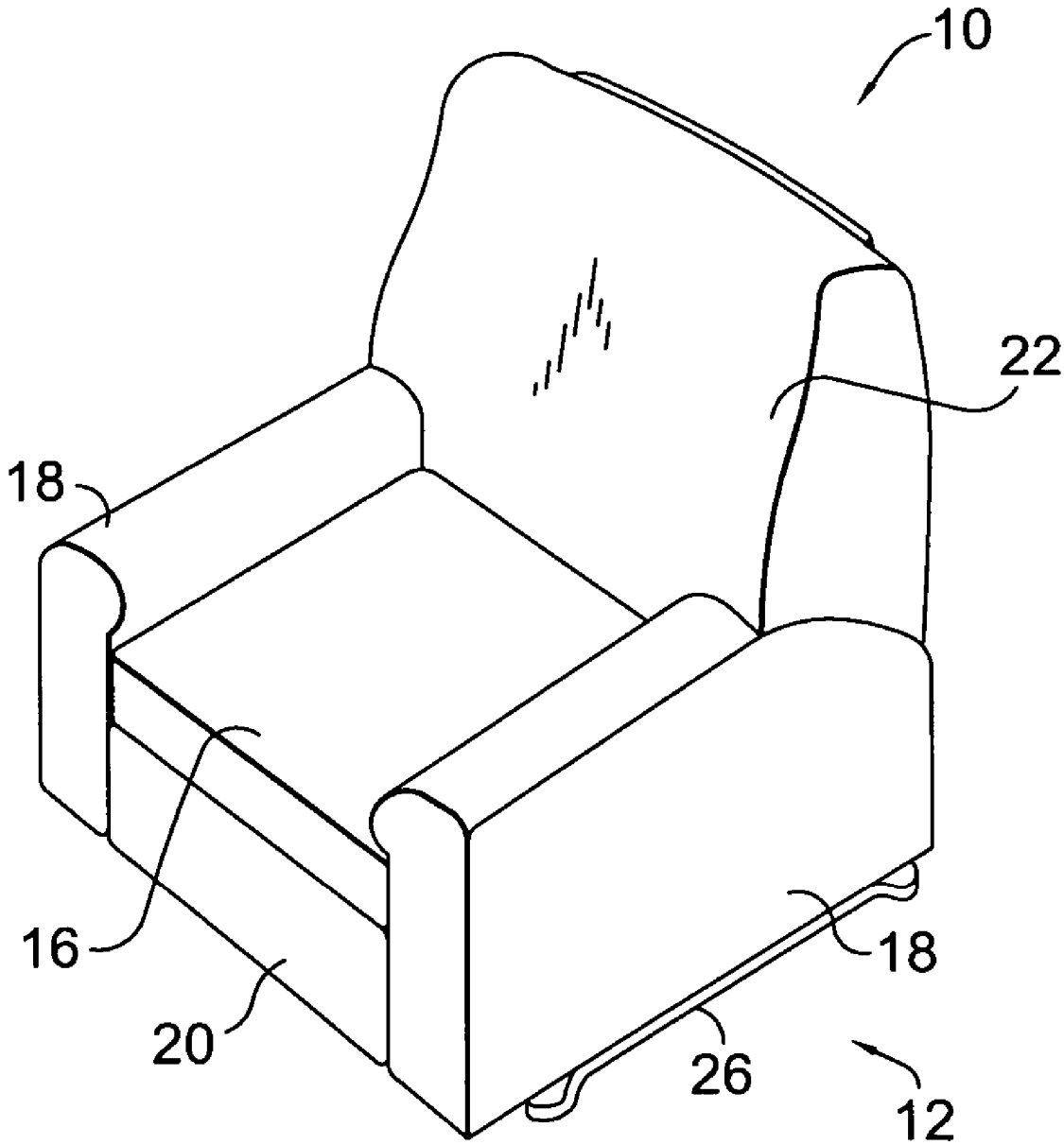
FIG. 1 is a front perspective view of a rocker recliner chair according to the present invention.
Figure 2:
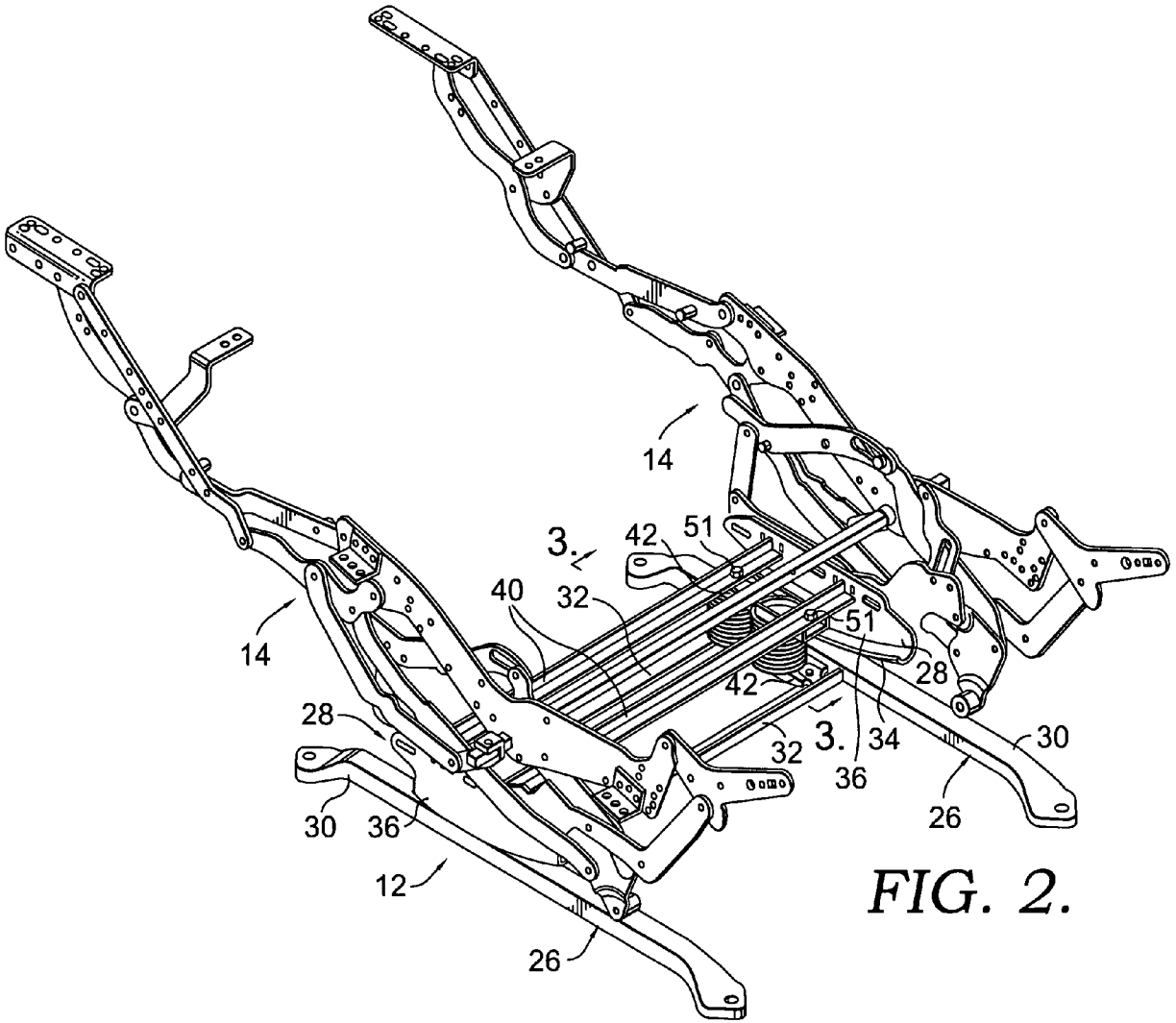
FIG. 2 is an isometric view of a rocker recliner chair, with parts removed, having a rocker mechanism.

Referring to the drawings in greater detail and initially to FIG. 1, a rocker recliner chair is shown and designated generally by the numeral 10. Generally, as best seen in FIGS. 1 and 2, the chair 10 broadly includes a rocker mechanism 12 that provides support for a pair of linkage mechanisms 14 positioned on opposite sides of the chair 10. Linkage mechanisms 14 mount a seat 16, a pair of upstanding opposed armrests 18, a footrest 20 and a backrest 22 to the rocker mechanism 12 for rocking movement and for movement between a closed (chair position), an open (TV position), and a fully reclined position.

Figure 3:
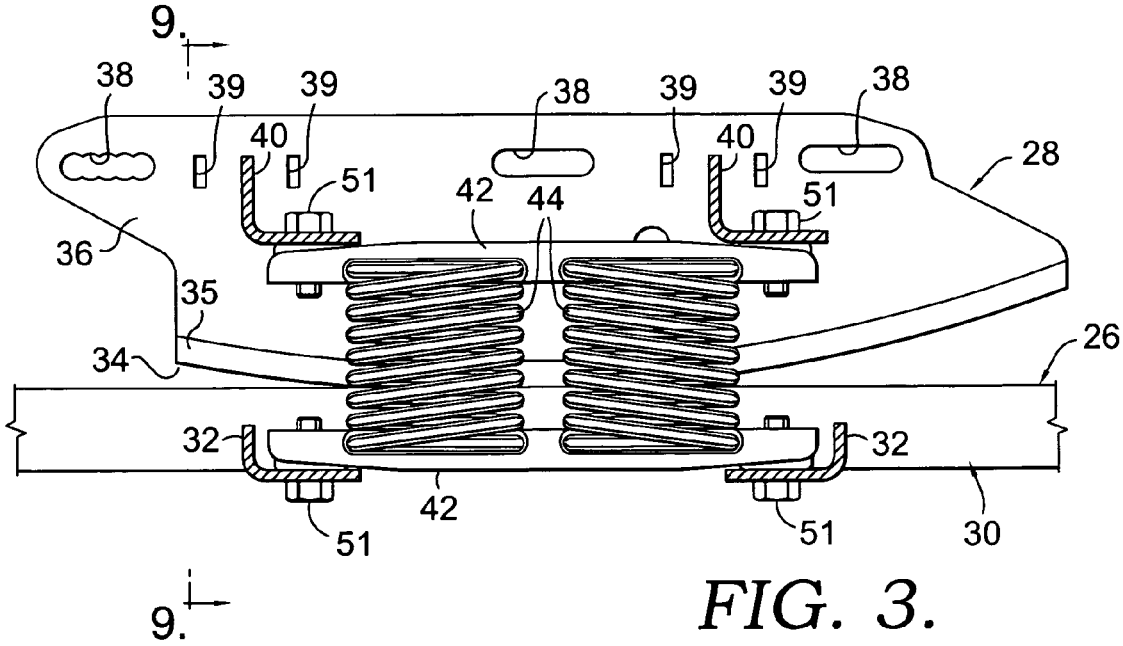
FIG. 3 is a partial, enlarged, cross-sectional view of the rocker mechanism of FIG. 2 taken along the lines 3-3.

Referring now to FIGS. 2 and 3, the rocker mechanism 12 will be discussed. The rocker mechanism 12 includes a support portion 26 and a pair of rocker cams 28. The support portion 26 includes a pair of side rails 30 positioned on opposite sides of the chair 10 and extending between front and rear portions of the chair 10. The support portion 26 further includes a first pair of cross rails 32 that interconnect the side rails 30 and extend between the sides of chair 10. The cross rails 32 have an L-shaped cross-section. It should be appreciated by one of ordinary skill in the art that any suitable cross-section may be used. The cross rails 32 attach to the side rails 30 by weldment. However, it should be appreciated by one of ordinary skill in the art that any suitable attachment method may be used.

Figure 9:
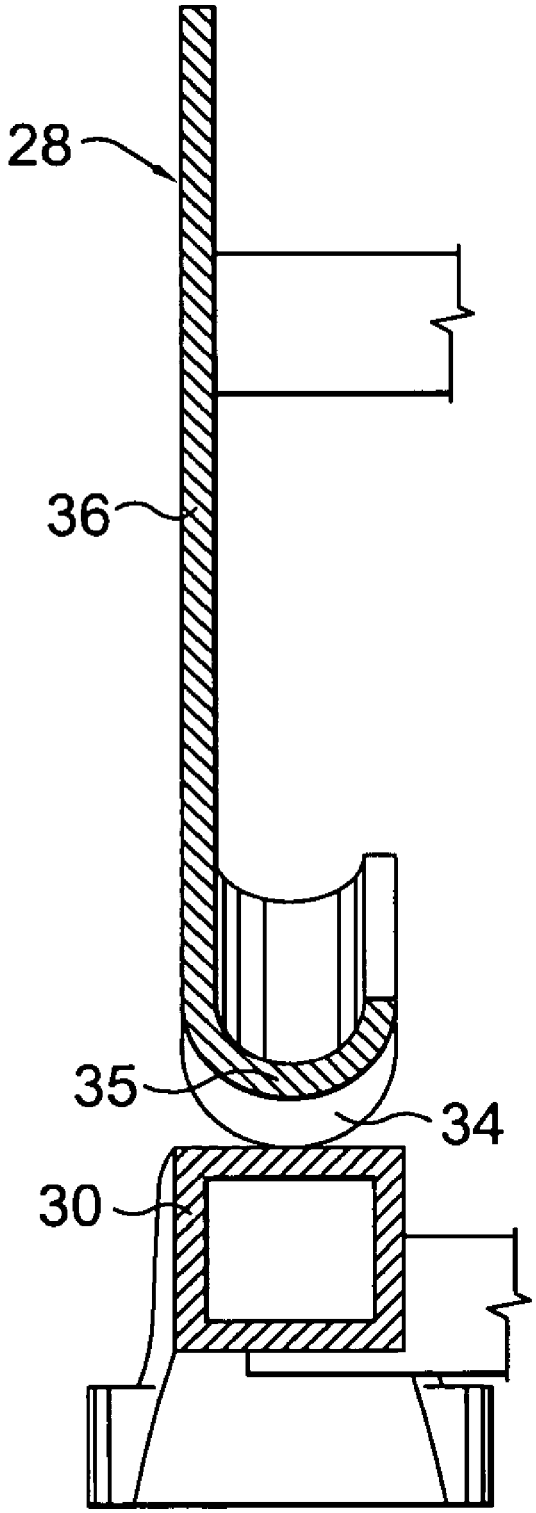
FIG. 9 is a partial, enlarged, cross-sectional view of the rocker cam assembly of FIG. 3 taken along the lines 9-9.

As shown in FIGS. 3 and 9, the rocker cam 28 is a single, unitary piece, shaped as shown, made from stamped steel. The rocker cam 28 includes a curved cam portion 34 and a sidewall 36. The cam portion 34 includes a crowned lip 35 that rests upon an upper surface of the side rails 30 and facilitates the rocking movement of the chair 10. The sidewall 36 is oriented generally vertically and extends upwardly from the cam portion 34. However, while the cam portion 34 is shown as a crowned lip 35, the cam portion 34 may also include a generally flat surface extending generally horizontally from the sidewall 34 or any other suitable configuration for facilitating the rocking movement of the chair. The sidewall 36 includes a plurality of apertures 38. The apertures 38 are used to mount the linkage mechanisms 14 to the rocker mechanism 12. The sidewall 36 further contains a plurality of slots 39 that facilitate attachment of a second pair of cross rails 40.

Figure 4:
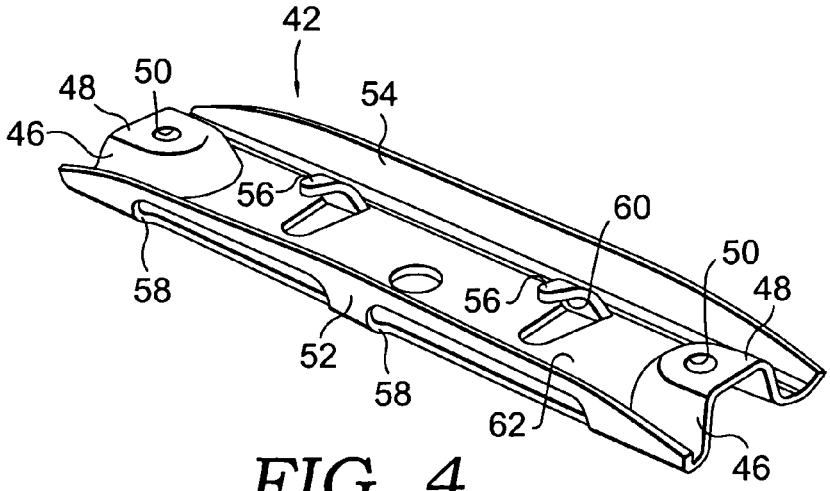
FIG. 4 is an isometric view of a spring retention device.

As shown in FIGS. 2 and 3, the second pair of cross rails 40 interconnect the sidewalls 36 of the rocker cams 28. The cross rails 40 have an L-shaped cross-section. However, it should be appreciated by one of ordinary skill in the art that any suitable cross-section may be used. As stated above, the rocker cams 28 rest on the side rails 30 on opposite sides of the rocker mechanism 12 and allow for forward and rearward rocking of the chair 10. As seen in FIGS. 2-4, and as further discussed below, a pair of spring retention devices 42 are coupled to the first and second pairs of cross rails 32, 40 with a set of springs 44 mounted there between. The spring retention devices 42 are shaped as shown and formed from stamped steel or any other suitable material. The spring retention devices 42 are located proximate each rocker cam 28. The spring retention devices 42 are generally planar, presenting top and bottom surfaces and front, rear, and side edges. As best seen in FIG. 4, the spring retention device 42 includes a pair of mounting portions 46 which facilitate fastening the spring retention device 42 to the cross rails 32, 40. The mounting portions 46 include a raised portion 48 and an aperture 50. The apertures 50 each receive a fastener 51 to attach the spring retention devices 42 to the cross rails 32, 40. The spring retention device 42 also includes a pair of protrusions 52, 54 located at each side of the spring retention device 42 and a pair of depending tabs 56. One protrusion 52 has a pair of elongate apertures 58 formed therein. The elongate apertures 58 are provided to receive the terminal leg of each of the set of springs 44 in order to couple the springs 44 to the first and second pairs of cross rails 32, 40.

As further illustrated in FIG. 4, the tabs 56 are formed in the spring retention device 42 and protrude from the spring retention device 42 by a distance sufficient enough to define a space between a lower surface 60 of the tab 56 and an upper surface 62 of the spring retention device 42. Preferably, tabs 56 are integrally formed with spring retention device 42 in a metal forming operation by cutting the desired shape and raising the tabs 56. The tabs 56 serve to retain the springs 44. After the terminal leg of the spring 44 is placed through the corresponding aperture 58, the tab 56 is moved to retain the spring in a crimping-like manner.

Figure 5:
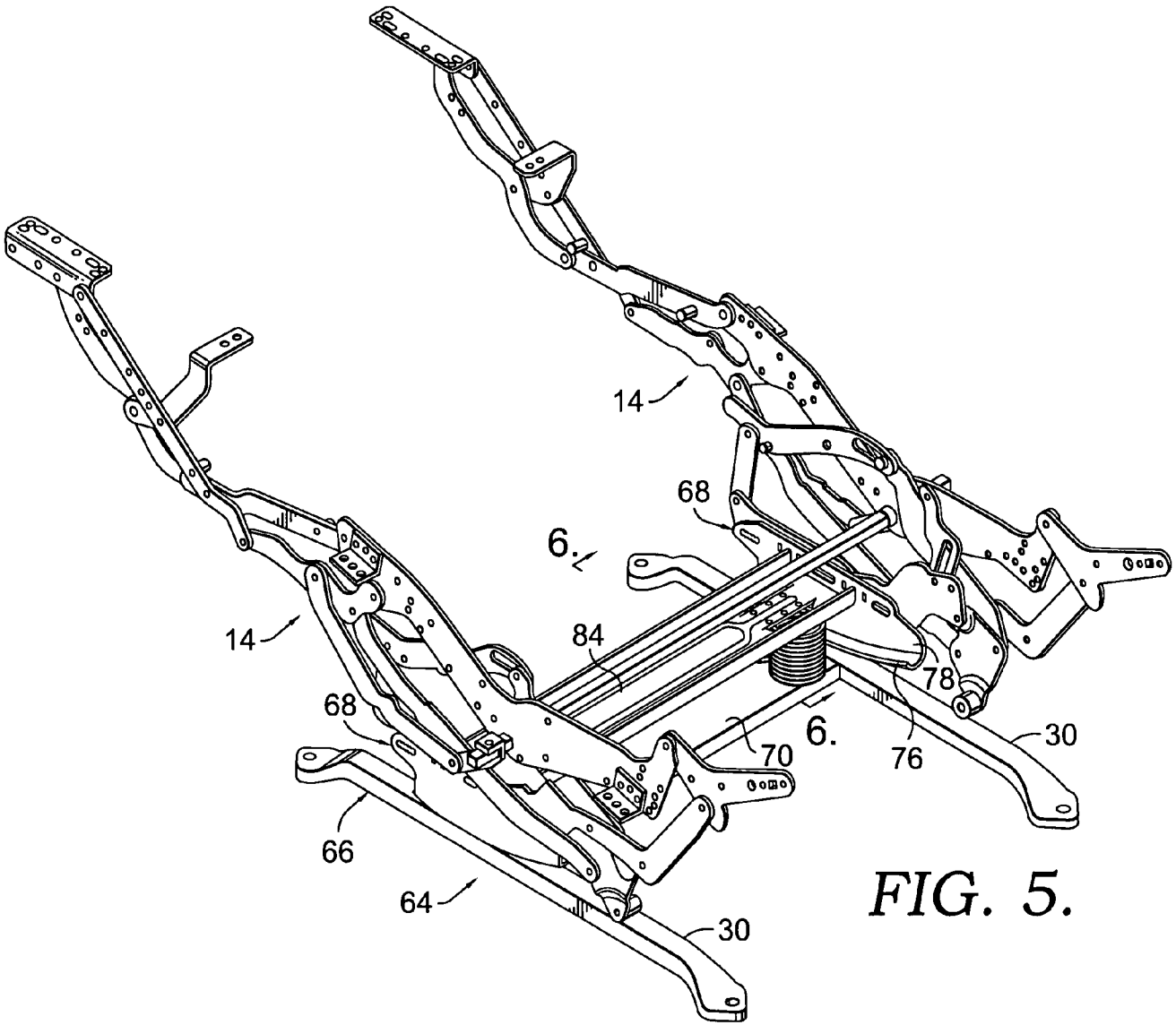
FIG. 5 is an isometric view of an additional embodiment of a rocker recliner chair, with parts removed, having a rocker mechanism.
Figure 6:
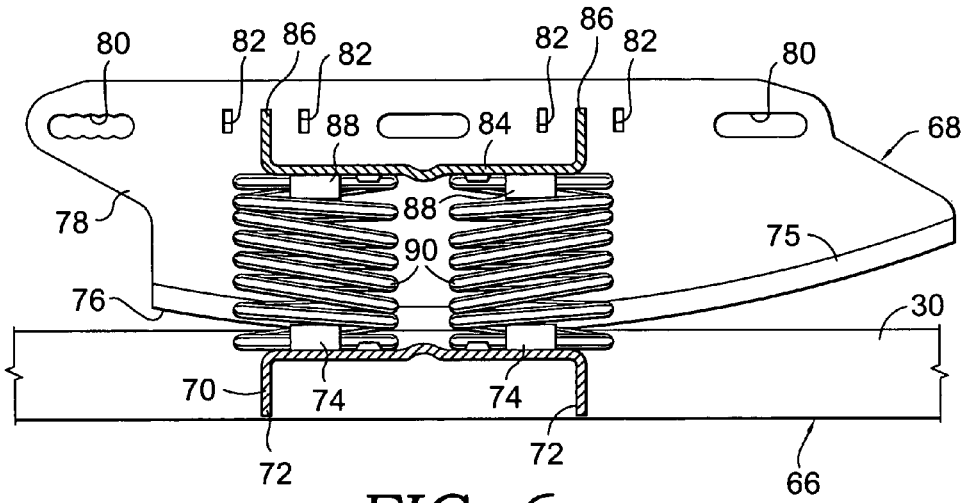
FIG. 6 is a partial, enlarged, cross-sectional view of the rocker mechanism of FIG. 5 taken along the lines 6-6.

Referring now to FIGS. 5 and 6, an additional embodiment of a rocker mechanism 64 will be discussed. The rocker mechanism 64 includes a support portion 66 and a pair of rocker cams 68. The support portion 66 includes a pair of side rails 30 positioned on opposite sides of the chair 10 and extending between front and rear portions of the chair 10. The support portion 66 further includes a first cross plate 70 that interconnects the side rails 30 and extends between the sides of chair 10. The first cross plate 70 is formed from stamped steel and is attached to the side rails 30 by weldment. However, it should be appreciated by one of ordinary skill in the art that any suitable attachment method may be used. The first cross plate 70 contains a pair of downwardly depending protrusions 72 along its length. The first cross plate 70 is attached at a position intermediate the front and rear portions of the chair 10. The first cross plate 70 preferably contains a number of tabs 74 formed therein, the purpose of which will be discussed further below.

The rocker cam 68 is a single, unitary piece, shaped as shown, formed from stamped steel. The rocker cam 68 includes a curved, cam portion 76 and a sidewall 78. The cam portion 76 includes a crowned lip 75 that rests upon an upper surface of the side rails 30 and facilitates the rocking movement of the chair 10. The sidewall 78 is oriented generally vertically and extends upwardly from the cam portion 76. However, while the cam portion 76 is shown as a crowned lip 75, the cam portion 76 may also include a generally flat surface extending generally horizontally from the sidewall 78 or any other suitable configuration for facilitating the rocking movement of the chair 10. The sidewall 78 includes a plurality of elongate apertures 80 that are used to mount the linkage mechanisms 14 to the rocker mechanism 64. The sidewall 78 further contains a plurality of slots 82 that facilitate attachment of a second cross plate 84. It should be understood that the rocker cam 68 of FIG. 6 is generally the same as the rocker cam 28 contained in FIGS. 3 and 9.

The second cross plate 84 interconnects the sidewalls 78 of the rocker cams 68. As stated above, the rocker cams 68 rest on the side rails 30 on opposite sides of the rocker mechanism 64 and allow for forward and rearward rocking of the chair 10. The second cross plate 84 is formed from stamped steel and is attached to the sidewalls 78 by weldment. It should be appreciated by one of ordinary skill in the art that any suitable attachment method may be used. The second cross plate 84 contains a pair of upwardly projecting protrusions 86 along its length. The second cross plate 84 is attached at a position intermediate the front and rear portions of the chair 10. The second cross plate 84 preferably contains a number of tabs 88 formed therein. The tabs 74, 88 on the first and second cross plates 70, 84 are used to mount a plurality of springs 90 there between. It should be understood that other methods of attaching the springs 90 to the first and second cross plates 70 and 84 could be used and are within the scope of this invention.

Figure 10:
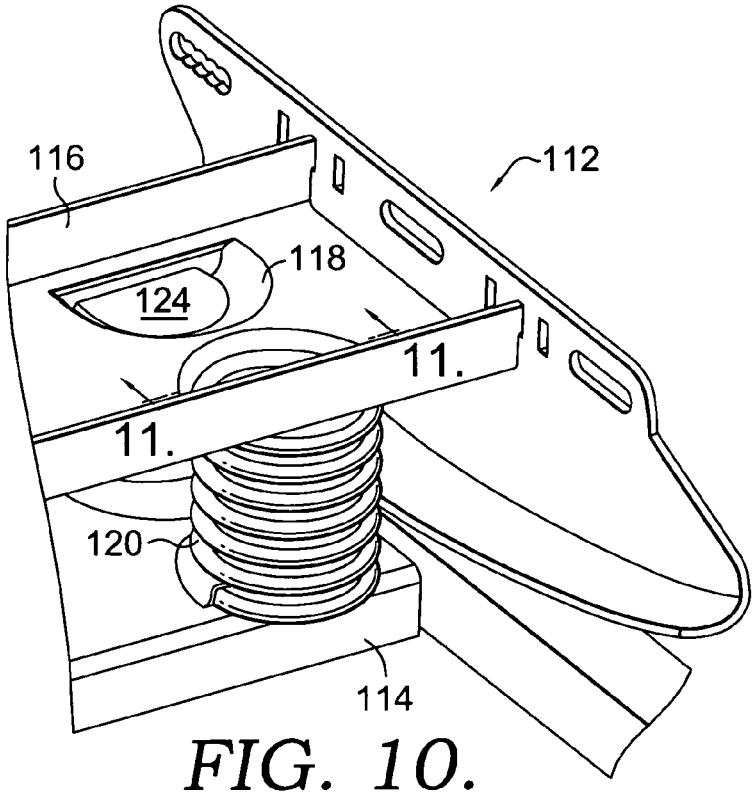
FIG. 10 is a partial, enlarged perspective view of an additional embodiment of a rocker cam assembly.
Figure 11:
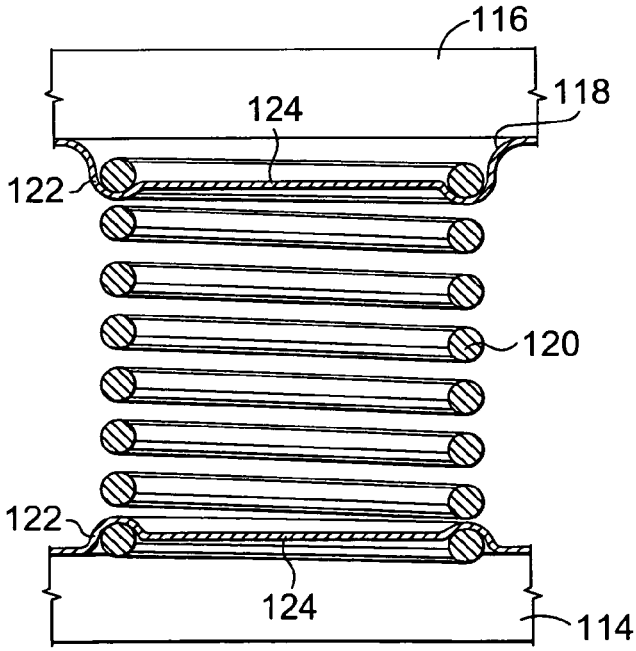
FIG. 11 is a partial, enlarged, cross-sectional view of the rocker cam assembly of FIG. 10 taken along the lines 11-11.

Referring now to FIGS. 10 and 11, an additional embodiment of a rocker mechanism 112 will be discussed. It should be understood that the rocker mechanism 112 includes all the same components as the rocker mechanism 64 disclosed in FIGS. 5, 6, and 9, with the exception of the tabs 74, 88 located in the first and second cross plates 74, 80. In contrast, the mechanism 112 contains first and second cross plates 114, 116 that contain a plurality of C-shaped grooves 118. The C-shaped grooves 118 are used to mount a plurality of springs 120 between the first and second cross plates 114, 116. The C-shaped grooves 118 contain an arcuate sidewall 122 and a raised portion 124. The arcuate sidewall 122 receives the spring 120 while the raised portion 124 holds the spring in place.

The above description provides a rocker mechanism for a rocker recliner chair that is less complex than other prior art rocker cam assemblies. The rocker mechanism utilizes fewer parts, and thus less material, while achieving improved performance. To aid in the illustration the prior art mechanism briefly described in the background section with respect to FIGS. 7 and 8 is illustrative.

Figure 8:
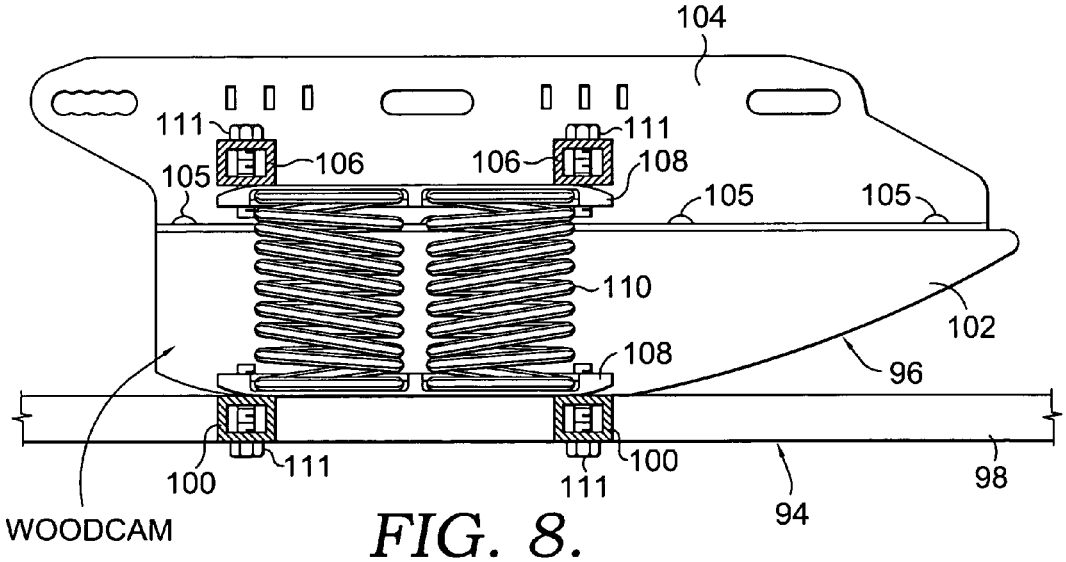
FIG. 8. (PRIOR ART)
FIG. 8 is a partial, enlarged, cross-sectional view of the rocker cam assembly of FIG. 7 taken along the lines 8-8.
Figure 7:
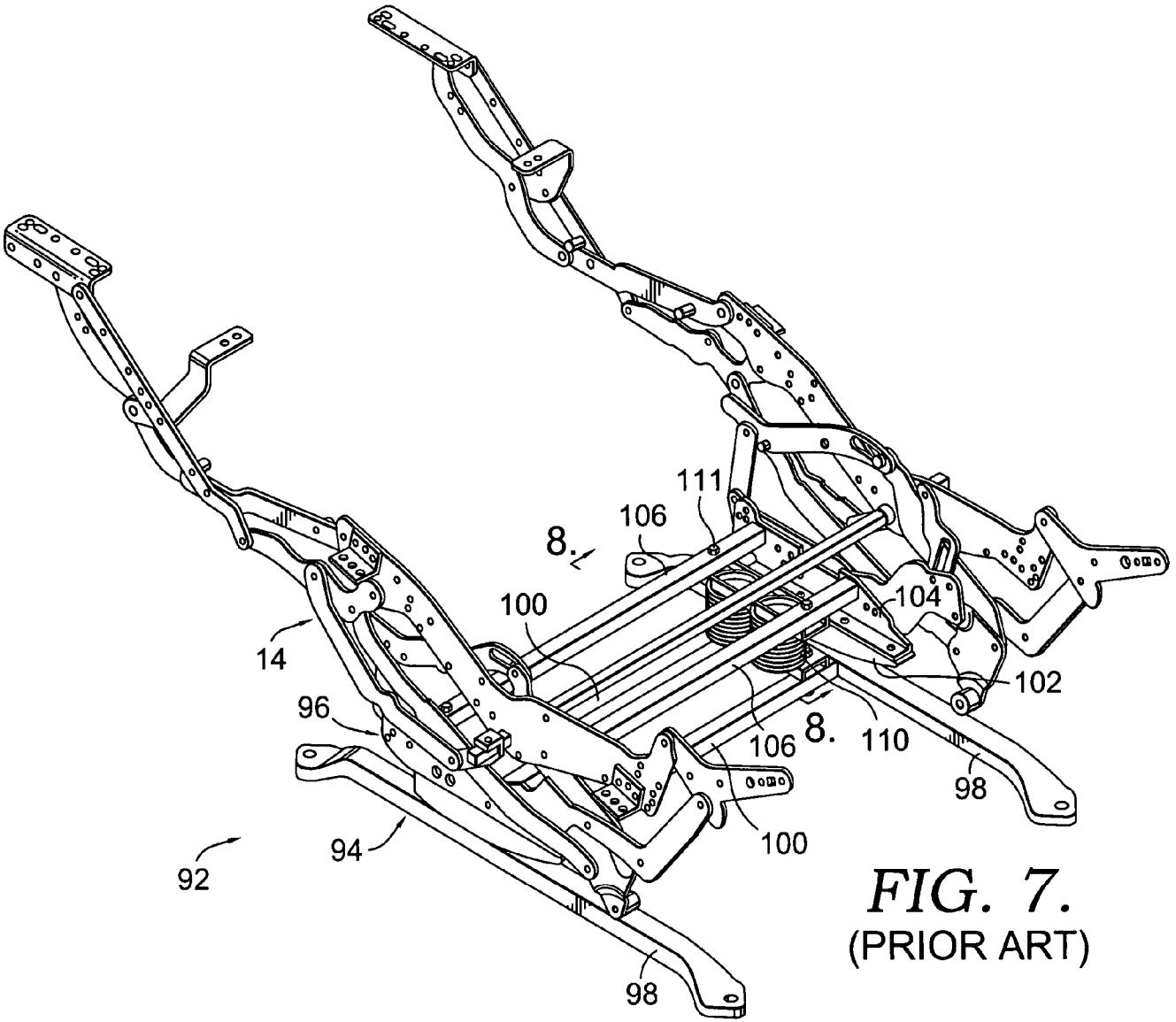
FIG. 7. (PRIOR ART)
FIG. 7 is an isometric view of a prior art embodiment of a rocker recliner chair having a rocker cam assembly.

As shown in FIGS. 7 and 8, the prior art mechanism 92 includes a rocker mechanism 94 and a rocker cam assembly 96. The rocker mechanism 94 includes a pair of side rails 98 positioned on opposite sides of the chair and extending between front and rear portions of the chair. A first pair of cross tubes 100 interconnect the side rails 98 and extend between the sides of the chair. The rocker cam assembly 96 includes a pair of rocker cams 102 and a pair of mounting brackets 104. A second pair of cross tubes 106 interconnect the mounting brackets 104. The rocker cams 102 are made from wood (as labeled in FIG. 8) or any other suitable composite material. The rocker cams 102 rest on the side rails 98 on opposite sides of the rocker mechanism 94 and allow for forward and rearward rocking of the chair. The mounting brackets 104 are fixably coupled to an upper portion of the rocker cams 102. For example, the brackets 104 are typically secured to the cams 102 by a number of wood screws 105. A pair of spring retention devices 108 are coupled to the first and second pairs of cross tubes 100, 106 using fasteners, such as bolts 111. A set of springs 110 is mounted between the retention devices 108 on each side. As can be seen this arrangement requires the side rails, a first and second pair of cross tubes, a pair of wooden cams and a pair of mounting brackets, as well as four spring retention devices, four springs and associated fasteners such as the wood screws 105 and the bolts 111. In contrast, the invention illustrated in FIGS. 5 and 6, for example, preferably utilizes only the side rails, a pair of cams, a first and a second cross plate, and four springs. So it can be seen that fewer parts are needed to produce a rocking mechanism that yields a similar motion for the user of the chair.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A rocker mechanism for a rocker recliner chair having a seat, a back, a footrest, a pair of armrests and a recliner mechanism, the rocker mechanism comprising:

a pair of spaced apart side rails;

a first member interconnecting the side rails;

a pair of single piece rocker cams having a cam surface and a sidewall projecting upwardly from the cam surface, wherein the cam surface rests on an upper surface of each of the side rails;

a second member interconnecting the sidewalls; and a plurality of springs coupling the first and second members.

2. The rocker mechanism of claim 1, wherein the cam surface is curved.

3. The rocker mechanism of claim 2, wherein the rocker cams are formed from stamped steel.

4. The rocker mechanism of claim 3, wherein the first member is a plate having at least one projection along its length.

5. The rocker mechanism of claim 4, wherein the second member is a plate having at least one projection along its length.

6. The rocker mechanism of claim 5, wherein the plates contain a plurality of tabs, wherein the tabs facilitate attachment of the plurality of springs directly to the first and second plates.

7. The rocker mechanism of claim 5, wherein the plates contain a plurality of C-shaped grooves, wherein the C-shaped grooves facilitate attachment of the plurality of springs directly to the first and second plates.

8. The rocker mechanism of claim 3, wherein the first member includes a pair of cross rails.

9. The rocker mechanism of claim 8, wherein the second member includes a pair of cross rails.

10. The rocker mechanism of claim 9, further including a plurality of spring retention devices coupled to the cross rails, the spring retention devices being adapted to couple the plurality of springs to the cross rails.

11. The rocker mechanism of claim 10, wherein the cross rails have an L-shaped cross-section.

12. A rocker mechanism for a rocker recliner chair having a seat, a back, a footrest, a pair of armrests and a recliner mechanism, the rocker mechanism comprising:

a pair of spaced apart side rails;

a first plate interconnecting the side rails;

a pair of single piece rocker cams having a cam surface and a sidewall projecting upwardly from the cam surface, wherein the cam surface rests on an upper surface of each of the side rails;

a second plate interconnecting the sidewalls; and a plurality of springs directly coupling the first and second plates.

13. The rocker mechanism of claim 12, wherein the cam surface is curved.

14. The rocker mechanism of claim 13, wherein the rocker cams are formed from stamped steel.

15. The rocker mechanism of claim 14, wherein the plates contain at least one projection along their length.

16. The rocker mechanism of claim 15, wherein the plates contain a plurality of tabs, wherein the tabs facilitate attachment of the plurality of springs.

17. The rocker mechanism of claim 15, wherein the plates contain a plurality of C-shaped grooves, wherein the C-shaped grooves facilitate attachment of the plurality of springs directly to the first and second plates.

18. A rocker mechanism for a rocker recliner chair having a seat, a back, a footrest, a pair of armrests, and a recliner mechanism, the rocker mechanism comprising:

a pair of spaced apart side rails;

a first pair of cross rails interconnecting the side rails;

a pair of single piece rocker cams having a cam surface and a sidewall projecting upwardly from the cam surface, wherein the cam surface rests on an upper surface of each of the side rails;

a second pair of cross rails interconnecting the sidewalls; and a plurality of spring retention devices coupled to the first and second pairs of cross rails, the spring retention devices being adapted to couple a plurality of springs to the first and second pairs of cross rails.

19. The rocker mechanism of claim 18, wherein the sidewall is oriented generally perpendicular to the cam surface.

20. The rocker mechanism of claim 19, wherein the rocker cams are formed from stamped steel.

21. The rocker mechanism of claim 20, wherein the cross rails have an L-shaped cross-section.

* * * * *